US005826760A

United States Patent [19]

Kolton et al.

[11] Patent Number: 5,826,760

[45] **Date of Patent: *Oct. 27, 1998**

[54] GARMENT HANGER

[75] Inventors: Chester Kolton, Westfield; Stuart S. Spater, Livingston, both of N.J.

[73] Assignee: B&G Plastics, Inc., Newark, N.J.

[ * ] Notice: The term of this patent shall not extend beyond the expiration date of Pat. No. 5,429,284.

[21] Appl. No.: 886,679

[22] Filed: Jul. 1, 1997

[51] Int. Cl.[6] ..... A47G 25/34; A47G 25/14

[52] U.S. Cl. ..... 223/85; 223/87

[58] Field of Search ..... 223/87, 85, DIG. 1, 223/94, 89, 88

[56] References Cited

U.S. PATENT DOCUMENTS 5,429,284 7/1995 Kolton et al. ..... 223/87

5,501,378 3/1996 Kolton et al. ..... 223/87

5,505,351 4/1996 Najarian ..... 223/87

5,620,118 4/1997 Kolton et al. ..... 223/87

*Primary Examiner*—Bibhu Mohanty

*Attorney, Agent, or Firm*—Robin, Blecker & Daley

[57] ABSTRACT

A garment hanger comprises first and second one-piece members, the first member having a hook portion for the receipt of a display rod and a main portion depending from the hook portion and defining an opening therethrough. A garment support member is disposed in the main portion opening and is movable relative to the first member. The second member is securable to a lower part of the main portion of the first member and is configured when so secured to define therewith a slot below the main portion opening.

4 Claims, 3 Drawing Sheets

GARMENT HANGER

FIELD OF THE INVENTION

This invention relates generally to hangers for garments and pertains more particularly to hangers for enhanced retention of garments, such as ties.

BACKGROUND OF THE INVENTION

FIGS. 1–3 depict a presently known commercial tie hanger 10, comprised of an integral plastic body having a first flap portion 12, having a generally trapezoidal cutout 14. Hanger 10 has a fold segment portion defined by fold line parts 16 and 18, each contiguous with flap portion 12 and of lesser depth than the depth of hanger 10 generally, as is seen particularly for fold line part 18 in FIG. 2.

A second flap portion 20 is contiguous with fold line parts 16 and 18 and includes a hook 22 having slot 22A for receipt of a display rod and tie receiving openings 24, 26 and 28 and latching openings 30 and 32.

On its rearward side, hanger 10 includes latching projections 34, each inclusive of shank 36, having a diameter somewhat less than that of openings 30 and 32, and having detents 38L (left side) and 38R (right side), respectively for forced passage through openings 30 and 32 and sized to be larger in diameter than the diameters of openings 30 and 32.

In use of hanger 10, a tie is passed through opening 24 and the rearward course of the tie is then passed through opening 26 to meet with the forward course of the tie. Then, both courses of the tie are jointly passed through opening 28 to be dressed rearwardly jointly of second flap portion 20 to extend therebelow. At that juncture, first flap portion 12 is folded about fold line parts 16 and 18 and detents 38L and 38R are forced into openings 30 and 32 to provide for capture of the two tie courses between flaps 12 and 20.

As is seen particularly in FIG. 3, the fold line parts 16 and 18 appear to the side of hanger 10 as so folded. Further, a quite extensive amount of plastic material is involved in hanger 10, i.e., the folded flaps 12 and 20 are coextensive, save for hook 22 and cutout 14.

From applicants' perspective, the need for generally coextensive folded members for retaining the two courses of the tie exiting the hanger consumes undue plastic material.

SUMMARY OF THE INVENTION

The present invention has as its primary object the provision of improved garment hangers, particularly for tie-hanging.

A more particular object of the invention is to provide tie hangers requiring substantially less plastic material and providing a more aesthetically pleasing appearance than the above-discussed prior art hanger.

In attaining these and other objects, the invention provides a garment hanger comprised of first and second one-piece members, the first member having a hook portion for the receipt of a display rod and a main portion depending from the hook portion and defining an opening therethrough. A garment support member is disposed in the main portion opening and is movable relative to the first member. The second member is securable to a lower part of the main portion of the first member and is configured when so secured to define therewith a slot below the main portion opening.

In use of the hanger to hang, for example, a tie, the tie is looped about the garment support member and dressed along the lower part of the main portion of the first member. The second member is then applied to the first member in overlapping relation to the tie, which has a part thereof then resident in the slot defined by the first and second members.

The foregoing and other objects and features of the invention will be further evident from the following detailed description of a preferred embodiment thereof and from the drawings in which like components are identified by like reference numerals throughout.

DETAILED DESCRIPTION OF THE PREFERRED EMBODIMENTS

Figure 1:
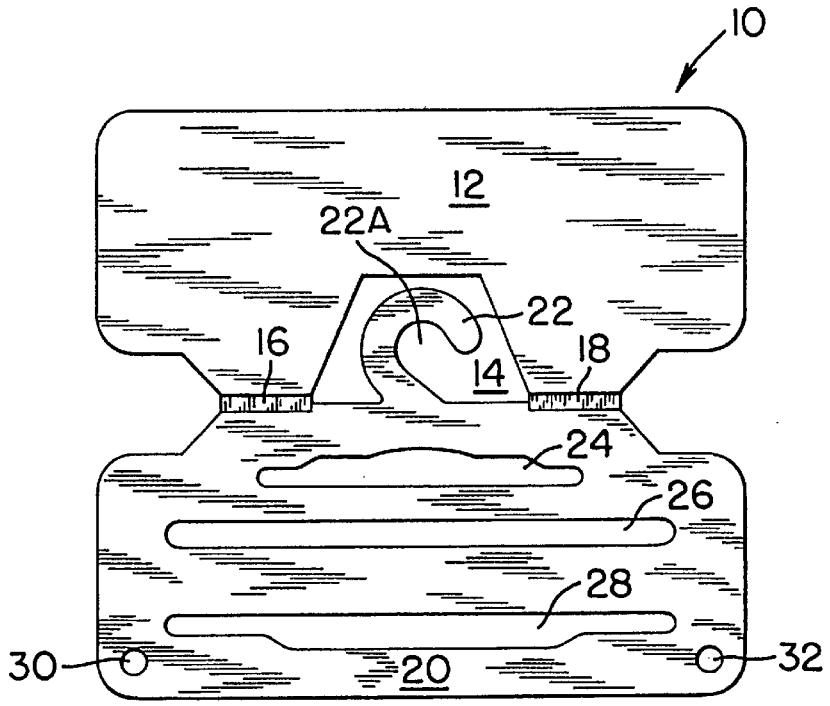
FIG. 1 (PRIOR ART)
FIG. 1 is a front elevational view of a prior art hanger.
Figure 2:
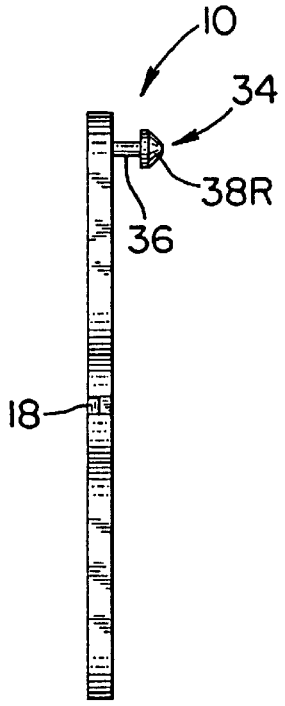
FIG. 2 (PRIOR ART)
FIG. 2 is a right side elevational view of the FIG. 1 hanger.
Figure 3:
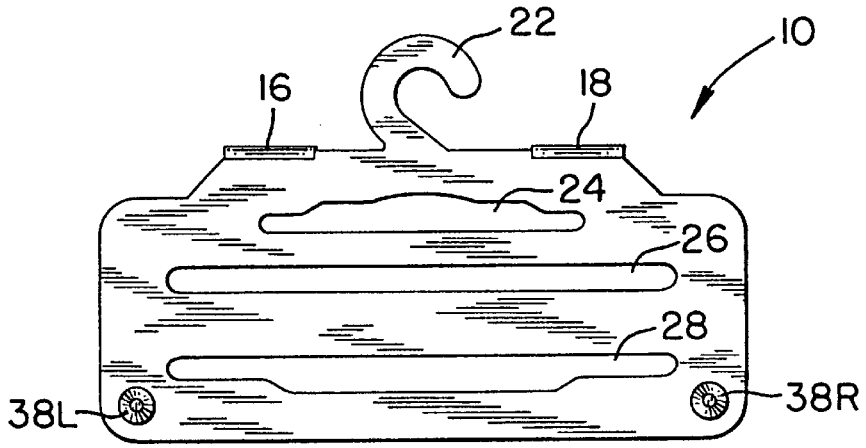
FIG. 3 (PRIOR ART)
FIG. 3 is a front elevational view of the FIG. 1 hanger upon folding thereof.
Figure 6:
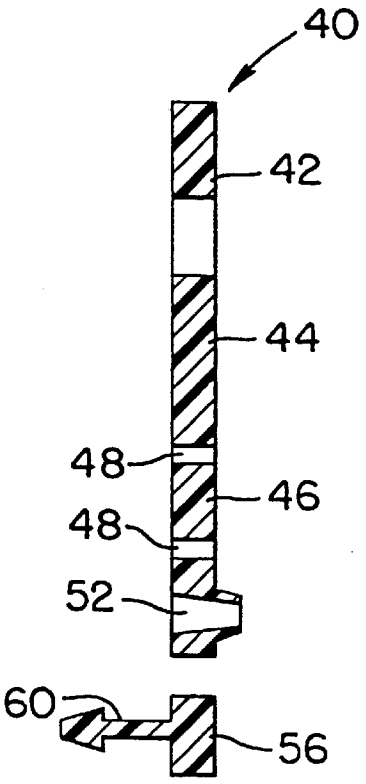
FIG. 6 is a sectional view of the FIG. 4 hanger as would be seen from broken plane VI—VI of FIG. 4.
Figure 4:
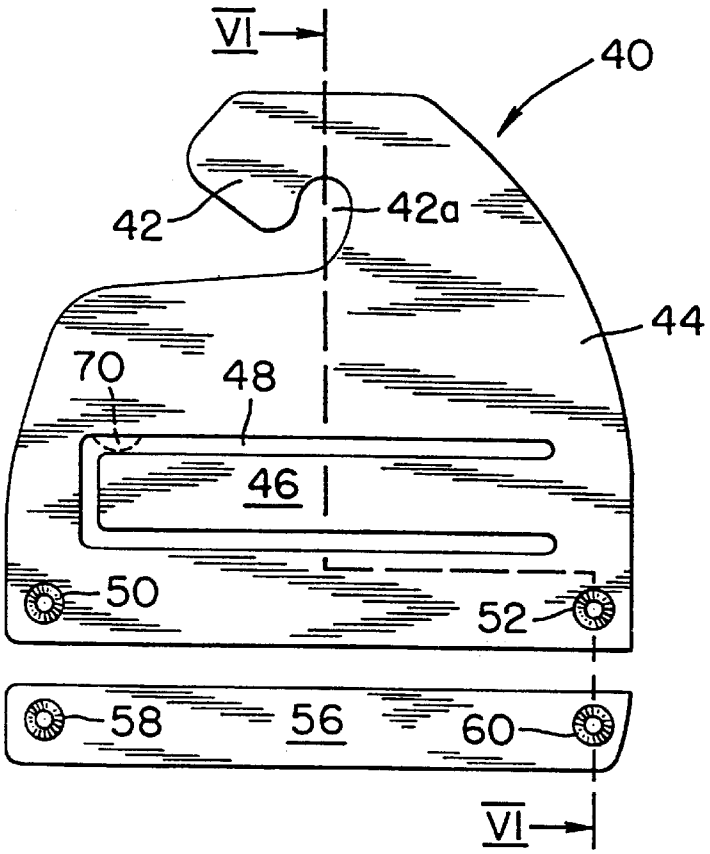
FIG. 4 is a front elevational view of a hanger in accordance with the subject invention.
Figure 5:
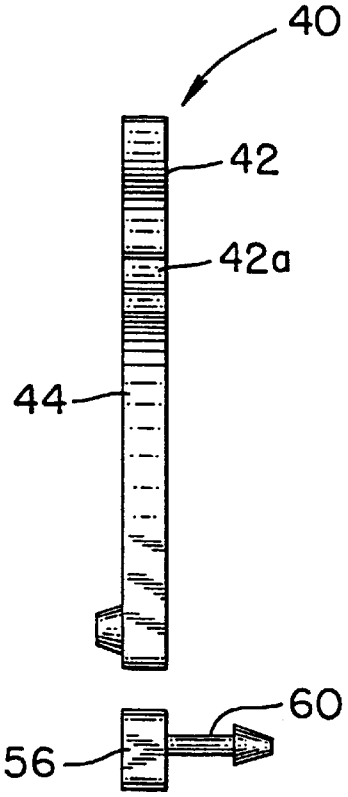
FIG. 5 is a left side elevational view of the FIG. 4 hanger.

Referring to FIGS. 4–6, garment hanger 40 is comprised of a first one-piece synthetic plastic member having a hook portion 42 with an opening 42A for the receipt of a display rod. A main portion 44 of hanger 40 depends from hook portion 42 and has a garment support member 46 disposed in opening 48 and cantilever-supported by the main portion. The main portion also includes latching openings 50 and 52 adjacent respective lateral margins thereof.

A second one-piece synthetic plastic member is in the form of a panel 56 with latching projections 58 and 60.

The latching openings 50 and 52 and projections 58 and 60 constitute coactive structure for retaining panel 56 against main portion 44. While the hanger may be constructed such that the retention is releasable, it is preferred that the retention not be releasable and that cutting is required to remove a hung garment from the hanger. Incorporating reference is made in this respect to commonly-owned U.S. Pat. No. 5,005,741, which describes in detail the non-releasable projections and latching recess structure shown in FIGS. 4–6.

The first member main portion 44 and the panel 56, upon assembly, jointly define slot 62 downwardly of opening 48.

Figure 7:
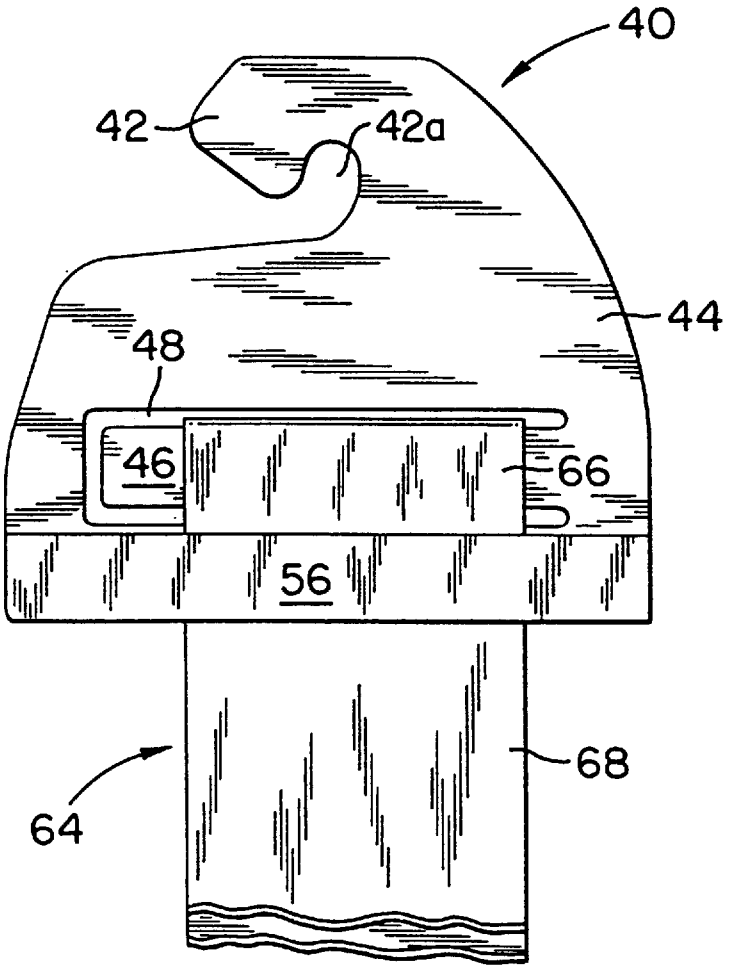
FIG. 7 is a front elevational view of the FIG. 4 hanger assembled with a tie.
Figure 8:
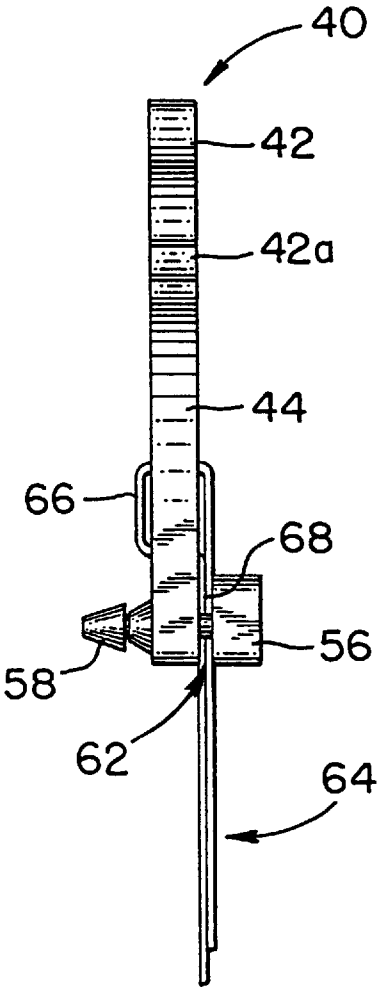
FIG. 8 is a left side elevational view of the FIG. 7 assembly.

Referring to FIGS. 7 and 8, hanger 40 is shown in assembly with tie 64, the tie having a first part 66 looped about support member 46 and a second part 68 extending through slot 62 (FIG. 8) and disposed between main portion 44 and panel 56.

In reaching the assembly of FIGS. 7 and 8, an assembler forms a tie with looped first part 66 and displaces support member 46 outwardly of the plane of the hanger, e.g., rearwardly of the plane of FIG. 4. The looped first part 66 is then dressed over and about support member 46 and the second part 68 is then dressed downwardly over main portion 44. Panel 56 is then secured to main portion 44 through engagement of projections 58 and 60 in openings 50 and 52.

Various changes to the particularly disclosed embodiment and practice may evidently be introduced without departing from the invention. By way of example, for smaller size hangers, the main portion may include a projection extending into its opening, shown in phantom at 70 in FIG. 4. The illustrated latching structure is used for applications in which high security is desired and may be replaced with other latching structure in other applications. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. A kit of parts for assembling a garment hanger comprising:

(a) a first one-piece member having a hook portion for said receipt of a display rod and a main portion depending from said hook portion and defining an opening therethrough, a garment support member disposed in said main portion opening and movable relative to said first member; and (b) a second one-piece member being securable to a lower part of said main portion of said first member and configured when so secured to define with said main portion of said first member a slot below said main portion opening.

2. The invention claimed in claim 1, wherein said main portion and said second member define coactive means for retaining said second member against said main portion.

3. The invention claimed in claim 2, wherein said coactive means is comprised of at least one projection on said second member and at least one latching opening in said main portion.

4. The invention claimed in claim 2, wherein said coactive means is comprised of first and second projections on said second member adjacent respective lateral margins thereof and first and second latching openings in said main portion adjacent respective lateral margins thereof.

* * * * *